United States Patent [19]

Kajiwara et al.

[11] Patent Number: 5,029,839

[45] Date of Patent: Jul. 9, 1991

[54] SHEET FEEDING APPARATUS

[75] Inventors: Norio Kajiwara, Ichikawa; Takeshi Matoba; Junichi Suzuki, both of Yokohama, all of Japan

[73] Assignee: Canon Kabushiki Kaisha, Tokyo, Japan

[21] Appl. No.: 576,167

[22] Filed: Mar. 31, 1990

Related U.S. Application Data

[63] Continuation of Ser. No. 296,354, Jan. 10, 1989, abandoned, which is a continuation of Ser. No. 878,204, Jun. 25, 1986, abandoned.

[30] Foreign Application Priority Data

Jan. 7, 1985 [JP] Japan ..... 60-099084
Jan. 7, 1985 [JP] Japan ..... 60-099085

[51] Int. Cl.[5] ..... B65H 3/52
[52] U.S. Cl. ..... 271/121; 271/122; 271/124
[58] Field of Search ..... 271/121, 122, 124, 10, 271/6

[56] References Cited

U.S. PATENT DOCUMENTS

| | | | |
|---|---|---|---|
| 4,085,929 | 4/1978 | Tuchiya et al. | 271/122 |
| 4,166,614 | 9/1979 | Hamlin et al. | 271/3.1 |
| 4,203,586 | 5/1980 | Hoyer | 271/122 X |
| 4,212,456 | 7/1980 | Ruenzi | 271/4 |
| 4,526,358 | 7/1985 | Ura et al. | 271/122 X |
| 4,575,068 | 3/1986 | Kato | 271/122 |

FOREIGN PATENT DOCUMENTS

| | | | |
|---|---|---|---|
| 110569 | 8/1979 | Japan | 271/122 |
| 0198241 | 11/1984 | Japan | 271/122 |
| 1227525 | 4/1971 | United Kingdom | 271/182 |

*Primary Examiner*—David H. Bollinger
*Attorney, Agent, or Firm*—Fitzpatrick, Cella, Harper & Scinto

[57] ABSTRACT

A sheet feeding apparatus of the invention comprises a conveying belt which is driven in such a direction as to send sheets, a belt or the like which is driven in the direction opposite to the belt conveying direction so as to apply a predetermined resistance force to the feeding of the sheets, and a frictional member adapted to be come into pressure contact with the conveying belt through the sheets. With the apparatus, the sheets can be certainly separated one by one irrespective of the material and thickness of the sheet.

16 Claims, 5 Drawing Sheets

SHEET FEEDING APPARATUS

This application is a continuation of application Ser. No. 07/296,354 filed Jan. 10, 1989, now abandoned which was a continuation of application Ser. No. 06/878,204, filed June 25, 1986 now abandoned.

BACKGROUND OF THE INVENTION

1. Field of the Invention

The present invention relates to a sheet feeding apparatus which can consistently separate and feed thin sheets in a facsimile, copying machine, or the like.

2. Related Background Art

In facsimile apparatus and the like, a plurality of sheets on the sheet supply plate are separated and fed one by one and the image drawn on the sheet is read by the reading section.

Namely, the frictional member comes into pressure contact with the conveying member which is rotating in the sheet conveying direction. The sheets are fed upstream to downstream the rotation of the conveying member. The sheets are separated one by one by the frictional force of the frictional member and sent to the reading section provided downstream.

In the apparatus having the construction as mentioned above, the relation of ($\mu_f > \mu_r > \mu_s$) must be held to separate and feed the sheets, wherein $\mu_f$ denotes a coefficient of friction between the conveying belt and the sheet, $\mu_r$ is a coefficient of friction between the separating belt and the sheet, and $\mu_s$ is a coefficient of friction between the sheets. In general, a rubber material is used for the conveying belt and separating belt since it provides a high coefficient of friction. In the relation among the belts and the sheet, the values of those coefficients of frictions are determined using normal paper which will be most frequently used as a reference so as to satisfy the foregoing relation among the coefficients of the friction.

In the feeding apparatus having the construction as mentioned above, if the foregoing relation among the coefficients of frictions is not satisfied, the sheets will not be able to be consistently and separated or fed. However, the coefficients of friction largely vary due to the circumstances of the apparatus such as temperature, humidity, and the like in use. Therefore, there is the problem such that in spite of the face that the sheets could be separated and fed in a certain state, when the temperature and humidity change, the relationships among the coefficients of friction also varies, so that the sheets cannot be separated and fed.

On the other hand, in the case of the normal papers, even in the case where the relation of ($\mu_f > \mu_r$) is held and the sheets can be consistently separated and fed, when the sheets having the smooth surfaces such as art papers, polyester films, or the like are used, there are the problems such that the sheets cannot be conveyed because the coefficient $\mu_r$ of friction between the separating belt and the sheet is larger than the coefficient $\mu_f$ of friction between the conveying belt and the sheet, and the like.

SUMMARY OF THE INVENTION

It is an object of the present invention to solve the foregoing conventional problems and to provide a sheet feeding apparatus which can consistently separate and feed sheets even if the material and kind of the sheets change.

The other objects and effects will be explained in the following detailed description.

A sheet feeding apparatus of the present invention which accomplishes the above object comprises: a conveying belt which is suspended and supported to a plurality of pulleys for feeding a sheet and which is rotated by driving means in the direction necessary to send the sheet; separating means such as separating belt, fixed frictional material, or the like which is similarly suspended and supported to a plurality of pulleys and which is rotated by the driving means in such a direction as to apply a predetermined resistance force to the sheet in a manner opposite to the conveying belt; and a frictional member which is brought into pressure contact with a part of the conveying belt through the sheet which is being conveyed.

According to the foregoing sheet feeding apparatus, in the case where the sheet is inserted between the conveying belt and the separating means and fed, the coefficient of friction between the separating means and the sheet increases. Therefore, even when the resistance force by the separating means increases, the sheet comes into pressure contact with the conveying belt by the frictional member. Thus, the sheet conveying force by this belt is large and misfeeding is precludes.

BRIEF DESCRIPTION OF THE DRAWINGS

FIG. 5-C is an explanatory diagram showing the relation among the forces in respective portions.

DETAILED DESCRIPTION OF PREFERRED EMBODIMENTS

An embodiment according to the present invention applied to a reading apparatus of a facsimile will now be described.

Figure 1:
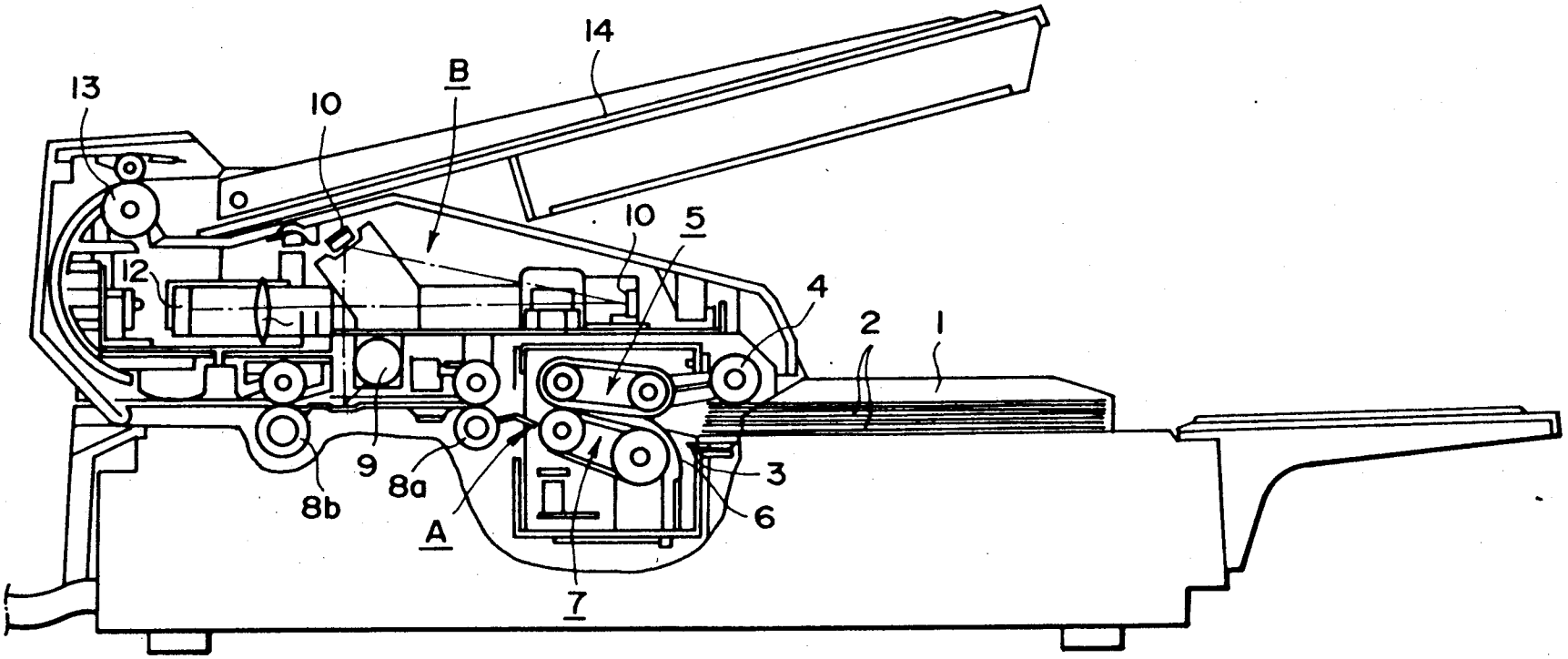
FIG. 1 is a cross sectional explanatory diagram of a reading apparatus of a facsimile machine to which an embodiment of the present invention is applied.

FIG. 1 is a cross sectional view of the reading apparatus of a facsimile machine. The outline of this apparatus will be described. A sheet supply plate 1 is arranged on the upstream side (right side in the diagram) of a sheet conveying route. A plurality of sheets 2 put on the plate 1 are detected by a sheet presence/absence sensor 3 and are sent by a pickup roller 4. These sheets are separated one by one and fed downstream (left side in the diagram) by a feeding section A consisting of conveying belt means 5, a frictional member 6 which is brought into pressure contact with the conveying belt means 5, and separating means 7.

On the other hand, a reading section B is arranged downstream of the feeding section A. The separated sheet 2 is conveyed at a constant speed by conveying rollers 8*a* and 8*b* and at the same time, the surface of the sheet is irradiated by a light source 9. The reflected light from the sheet surface is further reflected by a plurality of mirrors 10 and at the same time, the image written on the sheet 2 is read through a lens 11 by an image reading element 12 such as CCD, image sensor, or the like. The sheet 2 after the image has been read is discharged to a sheet discharge plate 14 by a discharge roller 13.

A construction of the feeding section A will now be described in detail. The conveying belt means 5 is attached to the conveying unit and the separating means 7 is attached to the separating unit. The respective units are attached to the main body of the apparatus.

Figure 2:
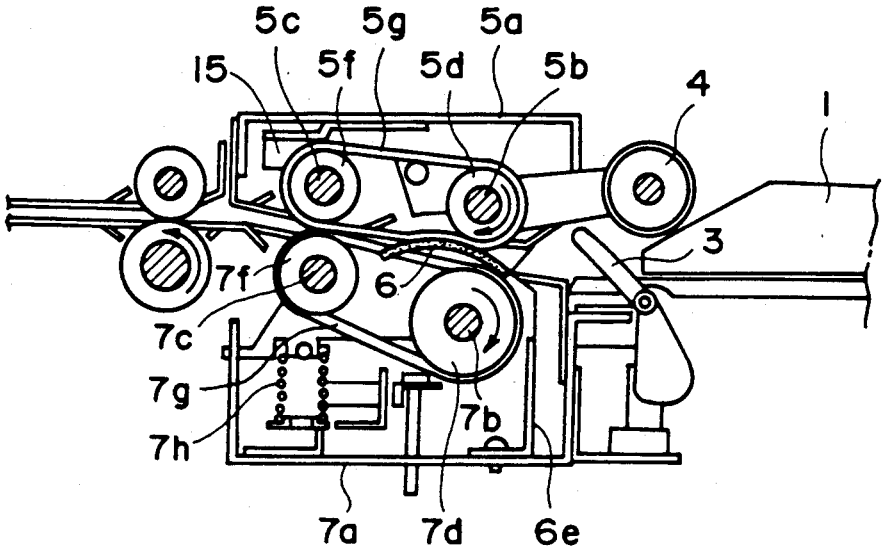
FIG. 2 is a cross sectional explanatory diagram of a sheet feeding section.
Figure 4:
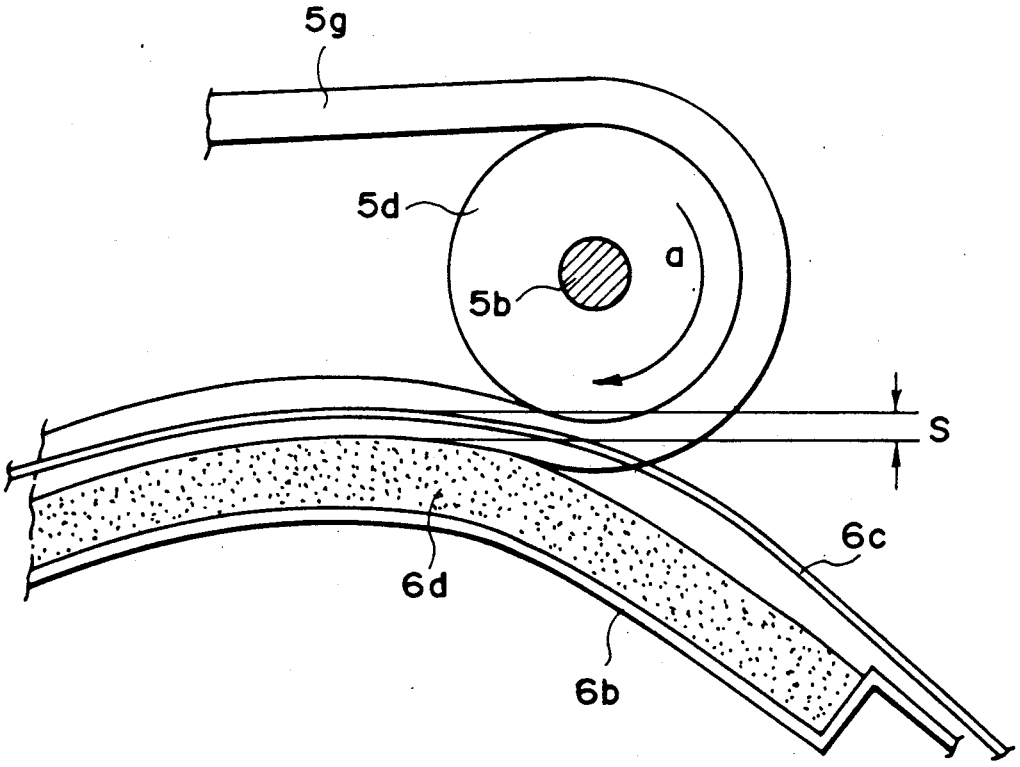
FIGS. 3 and 4 are explanatory diagrams of an auxiliary member.
Figure 3:
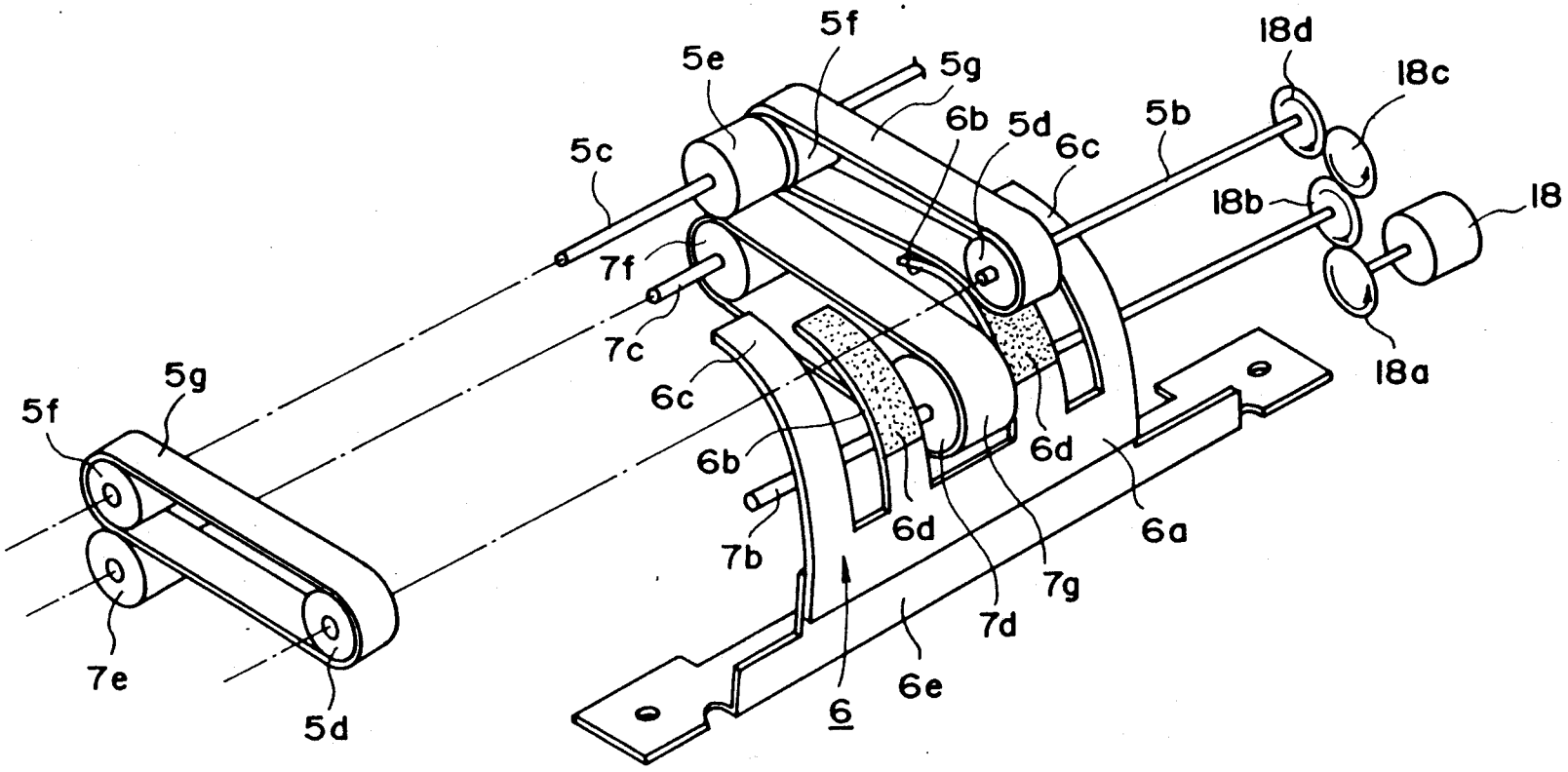

The conveying unit will be explained hereinbelow. As shown in FIGS. 2 to 4, a conveying shaft 5*b* is rotatably attached to the upstream side of a conveying unit frame 5*a* and a driven shaft 5*c* is also rotatably attached to the downstream side of the frame 5*a*, respectively. The driving force from a motor 18 is sequentially transferred to the conveying shaft 5*b* through a motor gear 18*a*, a separating shaft gear 18*b*, an idler gear 18*c*, and a conveying shaft gear 18*d*. A conveying drive pulley 5*d*is fixedly attached to the conveying shaft 5*b*. Conveying driven pulleys 5*f* are fixed to the driven shaft 5*c* on both sides of a conveying idler 5*e* rotatably attached to the driven shaft 5*c*. A conveying belt 5*g* made of a rubber material is suspended between both pulleys 5*d* and 5*f*.

The pickup roller 4 is arranged upstream of the conveying drive pulley 5*d* and drops onto the sheets 2 or ascends by a solenoid (not shown) which is made operative in response to a signal from the sheet presence/absence sensor 3 provided upstream of the pulley 5*d* and to a signal from a sheet edge sensor 15 provided downstream of the pulley 5*f*.

The separating means will now be described. The separating unit supporting the separating means is arranged below the conveying unit. A separating shaft 7*b* is rotatably attached to the upstream side of a separating unit frame 7*a* and a driven shaft 7*c* is also rotatably attached to the downstream side of the frame 7*a*. The driving force from the motor 18 is transferred from the motor gear 18*a* to the separating shaft 7*b* through the separating shaft gear 18*b*. A separating drive pulley 7*d* is fixed to the separating shaft 7*b*. A separating driven pulley 7*f* is fixedly or rotatably attached to the driven shaft 7*c* between two driven idlers 7*e* rotatably attached to the driven shaft 7*c*. Further, a separating belt 7*g* made of a rubber material is suspended between both pulleys 7*d* and 7*f*.

Further, the driven shaft 7*c* is vertically movable and urged upward by a pressing spring 7*h* attached to the separating unit frame 7*a*. Thus, the conveying belt 5*g* is brought into pressure contact with the separating idler 7*e* and the separating belt 7*g* approaches the conveying idler 5*e*.

A construction of the frictional member 6 will now be described. As shown in FIG. 3, the frictional member 6 is formed by a comb-like leaf spring member 6*a* which is bent in the sheet conveying direction. The leaf spring member 6*a* comprises: pressure contact portions 6*b* which are come into pressure contact with the conveying belts 5*g*; and guide portions 6*c* which have a low coefficient of friction are arranged on both sides of the pressure contact portion 6*b* to guide the feeding of the sheet 2. A frictional material 6*d* is adhered onto the upper surface of the pressure contact portion 6*b*. The frictional material 6*d* is constituted by forming a foamed resin layer having microporous and macroporous structures on an unwoven cloth base material, thereby constituting the fine nap or satinizing surface. According to the experiments, it has been found that it is suitable to form the frictional member 6*d* by polyurethane rubber as a raw material.

The leaf spring member 6*a* is attached to the separating unit frame 7*a* through a fixed plate 6*e*. When the separating unit is attached to the main body of the apparatus, the frictional material 6*d* is come into pressure contact with the upstream portion (on the side which is slightly downstream than the conveying drive pulley 5*d*) of the conveying belt 5*g*. Also, as shown in FIG. 4, the guide portion 6*c* is located slightly upward (at a distance of s) than the upper surface of the frictional material 6*d*.

In the above constitution, it is now assumed that a coefficient of friction between the conveying belt 5*g* and the sheet 2 is $\mu_f$, a coefficient of friction between the separating belt 7*g* and the sheet 2 is $\mu_r$, a coefficient of friction between the frictional material 6*d* and the sheet 2 is $\mu_m$, and a coefficient of friction between the sheets 2 is $\mu_s$. In this case, for the sheets which will be frequently used, those coefficients of frictions are set so as to satisfy the following relations:

$$\mu_f > \mu_r > \mu_s \text{ and } \mu_f > \mu_m > \mu_s.$$

The operation to separate and feed the sheets 2 by the apparatus having the construction as mentioned above will now be described.

First, when a plurality of sheets 2 are put on the sheet supply plate 1, the sheet presence/absence sensor 3 detects the presence of the sheets 2. When a start button (not shown) of the apparatus is pressed in this state, the pickup roller 4 drops onto the sheets 2 and also simultaneously rotates. The conveying drive pulley 5*d* and separating drive pulley 7*d* rotate clockwise in the directions as indicated by arrows a in FIGS. 5-A and 5-B.

First, the sheets 2 sent by the pickup roller 4 progress while they are guided by the guide portions 6*c* of the frictional member 6 as shown in FIG. 4. When the sheets 2 are conveyed in contact relation with the conveying belt 5*g*, the guide portions 6*c* are gradually depressed. Therefore, as shown in FIG. 4, even in the case where the edges of the sheets 2 are curled downward as well, they are guided by the guide portions 6*c* each having a low coefficient of friction. The edges of the sheets 2 will not come into contact with the frictional materials 6*d* each having a high coefficient of friction before they are brought into contact with the conveying belt 5*g*, so as to prevent that the edges of the sheets 2 are hooked by the portion of the frictional material 6*d*.

The sheets 2 sent to the feeding section A by the pickup roller 4 are conveyed in the downstream direction by the conveying belt 5*g* which is rotating. However, the sheet 2 of the highest layer and the sheet 2 of the lowest layer among the sheets 2 conveyed are separated by the separating belt 7*g* which is rotating in such a direction as to push and return the sheets 2. Thus, only one sheet 2 of the highest layer is supplied to the reading section B by the conveying belt 5*g*.

Figure 5A:
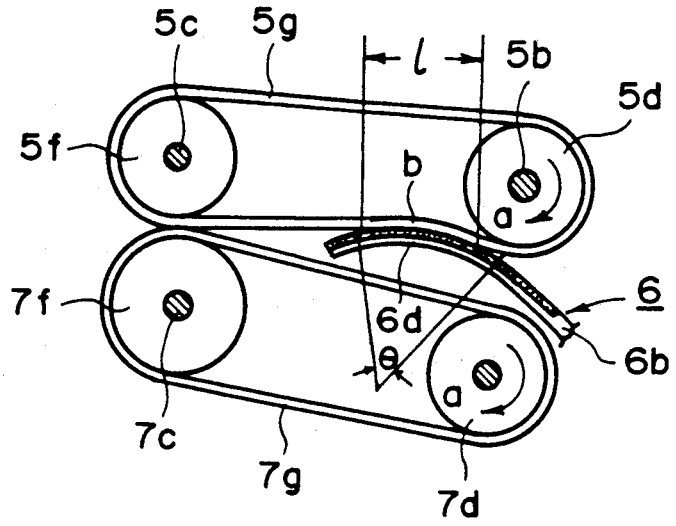
FIGS. 5-A and 5-B are explanatory diagrams of the sheet feeding function.
Figure 5B:
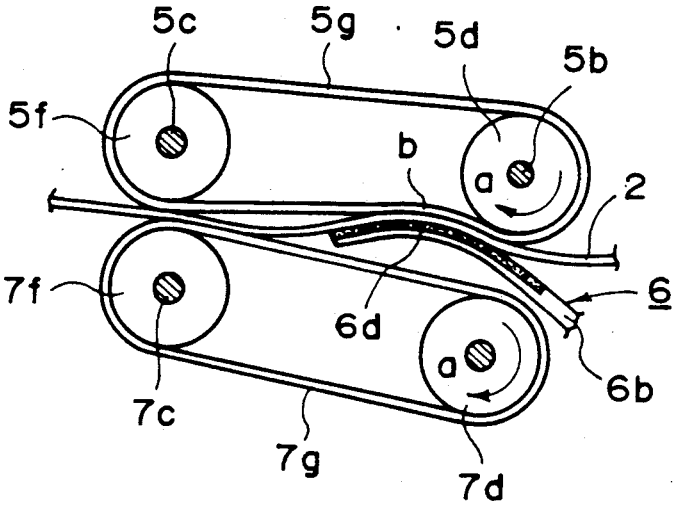
Figure 5C:
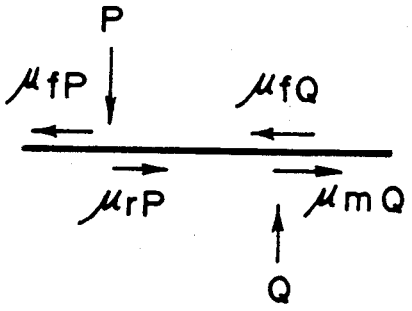

On the other hand, when the conveying drive pulley 5*d* is rotated clockwise in the directions as indicated by arrows a in FIGS. 5-A and 5-B in the foregoing state, the conveying belt 5*g* is sent in the portion b near the conveying drive pulley 5*d*. Thus, a slight slackness will occur in the portion b of the belt 5*g* (this slackness is more likely to occur as the sheet conveying load is large). Since the frictional member 6 having the curved shape is in pressure contact with the portion b where the slackness will occur, the conveying belt 5*g* is closely adhered along the curved shape of the frictional member 6 as shown in FIG. 5-A. Even if the pressure contact force between the frictional member 6 and the belt 5g is small as well, a sufficient contact length l will be secured. An angle $\theta$ of the contacting curved portion for the center of curvature is also large.

Therefore, as shown in FIG. 5-B, when the sheets are separated and fed due to the cooperating operation of the conveying belt 5g and frictional member 6, even if the pressure contact force therebetween is reduced as well, the extremely thin sheets 2 will be able to be surely separated. Further, since the sheets 2 are conveyed in the bent state along the curved surface of the contact portions of the conveying belt 5g and frictional member 6, when a number of sheets 2 are inserted, they are separated due to the foregoing bending separation effect.

Further, since the sheets 2 are subjected to the separating operation due to the separating belt 7g which rotates in such a direction as to push and return the sheets 2 as well, feeding a plurality of sheets 2 can be prevented.

Upon separating and feeding, on the other hand, since the frictional material 6d of the frictional member 6 is in pressure contact with the conveying belt 5g, the conveying force is also applied to the sheets 2 due to this pressure contact portion. Therefore, assuming that a force which the pressing spring 7h presses the separating belt 7g is P and a pressure contact force between the frictional material 6d and the conveying belt 5g due to the leaf spring member 6a is Q, the sheets 2 will be certainly separated and fed if the relation of $$(\mu_f-\mu_r)P+(\mu_f-\mu_m)Q>0$$

is satisfied as shown in FIG. 5-C.

Consequently, in the case where the sheets 2 are made of a material having a smooth surface such as art papers, $\mu_f$ is smaller than $\mu_r$ and $(\mu_f-\mu_r)P$ is smaller than 0. However, if the value of $(\mu_f-\mu_m)Q$ is set to be larger than the value of $(\mu_r-\mu_f)P$, the relation of the above expression is satisfied, so that the situation such that no sheet 2 is fed will not occur. Particularly, for the sheets having the relation of $\mu_f<\mu_r$, it is desirable to reduce the value of $\mu_m$. As mentioned before, the frictional material having the fine nap surface by forming the foamed resin layer of the microporous and macroporous structures on the unwoven cloth base material is suitable since the value of $\mu_m$ is reduced for the art papers or polyester film sheets.

Therefore, in the case of the art papers and the like which cause the situation such that no paper is fed in the conventional apparatus as well, according to the invention, these papers can be certainly fed without causing such a situation. Further, the separating effect of the sheets 2 also increases due to the frictional force by the frictional material 6d.

After the sheets 2 were separated and fed one by one, each sheet is conveyed to the downstream. When the front edge of the sheet passes through the sheet edge sensor 15, the pickup roller 4 ascends in response to the detection signal. When the rear edge of the sheet 2 passes through the sensor 15, the roller 4 again drops, thereby feeding the second and subsequent sheets 2 in a manner similar to the above.

Figure 6:
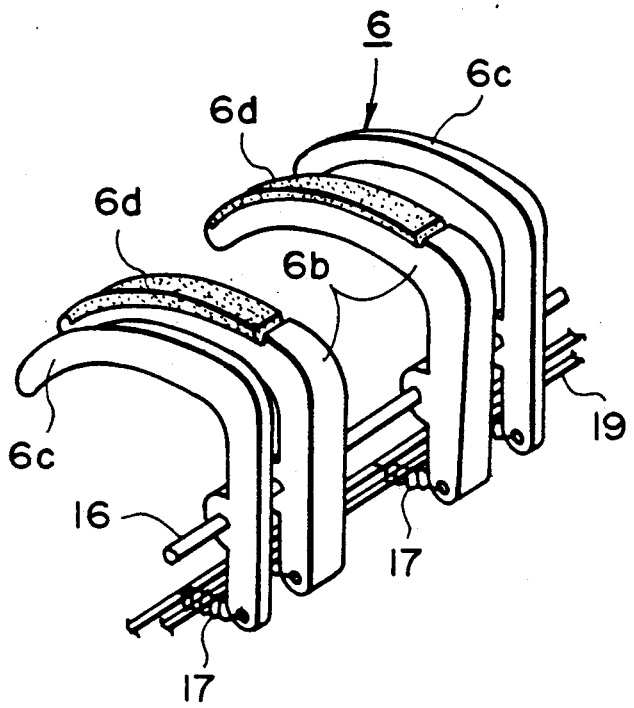
FIGS. 6 and 7 are explanatory diagrams of another embodiment.

Although the frictional member 6 has been constituted by the leaf spring member in the embodiment, as shown in FIG. 6, the similar effect can be also obtained by the following constitution. Namely, the pressure contact portion 6b and guide portion 6c of the frictional member 6 are formed of a rigid material, respectively, and they are rotatably attached to a shaft 16 attached to the separating unit frame 7a. A spring 17 is attached to the frictional member 6 such that the pressure contact portion 6b and guide portion 6c are deviated around the shaft 16 in the direction of the conveying belt 5g. In this manner, the elastic force is applied to the frictional member 6. Numeral 19 denotes a stopper.

On the other hand, the frictional member of which the frictional material 6d is adhered to the pressure contact portion 6b has been used as the frictional member 6 in the embodiment. However, even if the frictional material 6d is not provided as well, if the pressure contact portion 6b is in pressure contact with the conveying belt 5g at a predetermined pressure, the sheet conveying force will increase since the sheets 2 will be come into pressure contact with the conveying belt 5g due to this pressure contact portion. Therefore, even when $\mu_f$ is smaller than $\mu_r$, it is possible to prevent that no sheet is fed. In this case, it is desirable to set the pressure contact force to be small because unless otherwise, the separating force will decrease.

Figure 7:
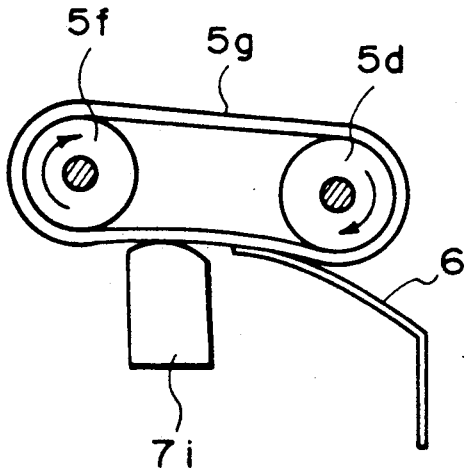

Further, in the embodiment, the rotary belts have been used as the conveying belt means 5 and separating means 7. However, in particular, the separating means 7 is not limited to the means which rotates, but a simple fixed frictional material 7i as shown in FIG. 7 may be also used if it can apply a predetermined resistance force when the sheet 2 is conveyed.

In addition, although the embodiment has been described with respect to the constitution such that the conveying belt means 5 has been arranged at the upper location and the separating means 7 has been arranged at the lower location, it is also possible to use the constitution such that the separating means 7 is arranged at the upper location and the conveying belt means 5 is arranged at the lower location.

As described above, according to the present invention, when the sheets are separated one by one by the separating means and conveyed by the conveying belt means, the frictional member adapted to come into pressure contact with the conveying belt means is provided. Therefore, even in the case of art papers, polyester film sheets, and the like which cause the situation such that no sheet is fed in the conventional apparatus as well, the sheets can consistently be fed.

In the case where the guide members each having a low coefficient of friction are provided on both sides, even for the sheets whose edges are curled downward as well, these edges are not hooked to the separating belt and frictional member, thereby making it possible to prevent the situation wherein no sheet is fed.

In addition, as described above, according to the present invention, in the case where the frictional member is come into pressure contact with the conveying belt on the upstream side in conveyance of the sheets where the slackness of the conveying belt is likely to occur, even if the pressure contact force between the frictional member and the conveying belt is small as well, the conveying belt will come into contact with the frictional member along the surface shape thereof. Therefore, even in the case of the extremely thin sheets, they can be also certainly separated and fed and at the same time, it is sufficient to set the pressure contact force between them to be small. Consequently, there are the advantages such that the load to the conveyance driving system is reduced and the abration of the conveying belt also decreases and the like.

What is claimed is:

1. A sheet feeding apparatus, comprising:

means for feeding stacked sheets;

a conveying belt rotatable to convey the sheets fed by said feeding means in a predetermined direction, said conveying belt contacting a first surface of the sheet for applying a frictional force thereto;

a first separating means for applying a frictional force to the sheets conveyed by said conveying belt in a direction contrary to said predetermined direction, said first separating means applying a frictional force to a second surface of the sheet to separate the sheets, said first separating means having a curved stationary separating surface contacting said conveying belt to apply said frictional force to the sheet, the coefficient of friction between said stationary separating surface and the sheet being selected to be smaller than the coefficient of friction between said conveying belt and the sheet, and larger than the coefficient of friction between sheets;

a second separating means for applying a frictional force on a downstream side of said first separating means to the sheets conveyed by said conveying belt in a direction contrary to said predetermined direction, said second separating means applying a frictional force to the second surface of the sheet to separate the sheets, said second separating means having a movable separating surface moving in a direction contrary to said predetermined direction for applying said frictional force to the sheets, and the coefficient of friction between said movable separating surface and the sheet being selected to be smaller than the coefficient of friction between said conveying belt and the sheet, and larger than the coefficient of friction between sheets.

2. A sheet feeding apparatus according to claim 1, wherein total of said frictional force in a direction contrary to said predetermined direction which is applied by said first separating means to the sheets, and said frictional force in a direction contrary to said predetermined direction which is applied by said second separating means to the sheets is selected smaller than said frictional force applied to the sheets by said conveying belt.

3. A sheet feeding apparatus according to claim 1, wherein said frictional force transmitted to the sheets from said conveying belt by pressing of said first separating means is selected larger than said frictional force in a direction contrary to said predetermined direction which is applied to the sheets from said first separating means.

4. A sheet feeding apparatus according to claim 1, wherein said first separating means includes a frictional member which is in contact with the sheets.

5. A sheet feeding apparatus according to claim 1, wherein said second separating means includes a reversible belt for applying said force in a direction contrary to said conveying force by said conveying means to said sheets.

6. A sheet feeding apparatus according to claim 1, wherein said conveying belt is suspended by plurality of rollers.

7. A sheet feeding apparatus according to claim 6, further including means for driving said rollers disposed at the location where said conveying belt is sent out toward said first separating means to thereby move said conveying belt.

8. A sheet feeding apparatus according to claim 7, wherein said first separating means has a convex curved surface which contacts said conveying belt.

9. A sheet feeding apparatus according to claim 1, wherein said first separating means is disposed on the downstream side of said conveying belt.

10. A sheet feeding apparatus, comprising:

means for feeding stacked sheets;

a conveying belt rotatable to convey the sheets fed by said feeding means in a predetermined direction, the conveying belt contacting a first surface of the sheet for applying a frictional force thereto;

a first separating means for applying a frictional force to the sheets conveyed by said conveying belt in a direction contrary to said predetermined direction, said first separating means applying a frictional force to a second surface of the sheet to separate the sheets, said first separating means having curved stationary separating surface contacting said conveying belt to apply said frictional force to the sheet, the coefficient of friction between said stationary separating surface and the sheet being selected to be smaller than the coefficient of friction between said conveying belt and the sheet, and larger than the coefficient of friction between sheets;

a second separating means which is on a downstream side of said first separating means in contract with the sheets to apply a frictional force thereto in a direction contrary to said predetermined direction, said second separating means applying a frictional force to the second surface of the sheet to separate the sheets;

the coefficient of friction between said second separating means and the sheet being selected to be smaller than the coefficient of friction between said conveying belt and the sheet, and larger than the coefficient of friction between sheets; and a first portion of said first separating means which is in contact with the sheets and a second portion of said second separating means which is in contact with the sheets are made from different materials.

11. A sheet feeding apparatus according to claim 10, wherein the total of said frictional force in a direction contrary to said predetermined direction which is applied by said first separating means to the sheets, and said frictional force in a direction contrary to said predetermined direction which is applied by said second separating means to the sheets is selected smaller than said frictional force transmitted to the sheets by said conveying belt.

12. A sheet feeding apparatus according to claim 11, wherein said first separating means includes a frictional member which is in contact with said sheets.

13. An image reading apparatus, comprising:

means for stacking sheets having an image thereon;

means for feeding the sheets stacked on said stacking means;

a conveying belt rotatable to convey the sheets fed by said feeding means in a predetermined direction, said conveying belt contacting a first surface of the sheet for applying a frictional force thereto;

a first separating means for applying a frictional force to the sheets conveyed by said conveying belt in a direction contrary to said predetermined direction, said first separating means applying a frictional force to a second surface of the sheet to separate the sheets, said first separating means having a curved stationary separating surface contacting said conveying belt to apply said frictional force to said sheet;

the coefficient of friction between said stationary separating surface and the sheet being selected to be smaller than the coefficient of friction between said conveying belt and the sheet, and larger than the coefficient of friction between sheets;

a second separating means for applying a frictional force on a downstream side of said first separating means to the sheets conveyed by said conveying belt in a direction contrary to said predetermined direction, said second separating means applying a frictional force to the second surface of the sheet to separate the sheets, said second separating means having a movable separating surface moving in a direction contrary to said predetermined direction for applying said frictional force to the sheets;

the coefficient of friction between said movable separating surface and the sheet being selected to be smaller than the coefficient of friction between said conveying belt and the sheet, and larger than the coefficient of friction between sheets;

a first portion of said first separating means which is in contact with the sheets and a second portion of said second separating means which is in contact with the sheets are made from different materials; and means for reading on a downstream side of said second separating means images on the sheets conveyed.

14. A sheet feeding apparatus, comprising:

means for feeding stacked sheets;

a conveying belt rotatable to convey the sheets fed by said feeding means in a predetermined direction, the conveying belt contacting a first surface of the sheet for applying the frictional force thereto;

a friction member disposed in a position opposing said conveying belt to hold the sheet together with said conveying belt, the friction member contacting a second surface of the sheet to apply the frictional force thereto, the coefficient of friction between the friction member and the sheet being selected to be smaller than the coefficient of friction between said conveying belt and the sheet and larger than the coefficient of friction between the sheets;

a separating belt disposed in a position unopposed to said conveying belt to contact the second surface of the sheet downstream, with respect to said predetermined direction, of the position at which said friction member contacts the second surface of the sheet to apply the conveying force in the direction contrary to the predetermined direction, the coefficient of friction between said separating belt and the sheet being selected to be smaller than the coefficient of friction between said conveying belt and the sheet and larger than the coefficient of friction between the sheets, a portion at which said friction member contacts the sheet and a portion at which said separating belt contacts the sheet being composed of different kinds of materials.

15. A sheet feeding apparatus according to claim 14, further comprising guide means disposed between said conveying belt and said friction member.

16. A sheet feeding apparatus according to claim 15, wherein said guiding means guides a tip end of the sheet so that the tip end of the sheet contacts said conveying belt earlier than said separating belt.

* * * * *

UNITED STATES PATENT AND TRADEMARK OFFICE

CERTIFICATE OF CORRECTION

PATENT NO. : 5,029,839

DATED : July 9, 1991

INVENTOR(S) : Norio Kajiwara, et al.

It is certified that error appears in the above-identified patent and that said Letters Patent is hereby corrected as shown below:

Title page , item:

[22] FILED:

Change "Mar. 31, 1990" to -- Aug. 31, 1990 --.

[30] FOREIGN APPLICATION PRIORITY DATA:

Change "Jan. 7, 1985 [JP] Japan.....60-099084" to -- July 1, 1985 [JP] Japan.....60-099084 --.

Change "Jan. 7, 1985 [JP] Japan.....60-099085" to -- July 1, 1985 [JP] Japan.....60-099085 --.

[57] ABSTRACT:

Line 6, delete "be".

UNITED STATES PATENT AND TRADEMARK OFFICE

CERTIFICATE OF CORRECTION

PATENT NO. : 5,029,839

DATED : July 9, 1991

INVENTOR(S) : Norio Kajiwara, et al.

It is certified that error appears in the above-identified patent and that said Letters Patent is hereby corrected as shown below:

COLUMN 1:

Line 22, change "downstream the" to -- downstream due to the --.

Line 42, change "frictions" to -- friction --.

Line 43, delete "and".

Line 47, change "face" to -- fact --.

Line 50, change "varies," to -- vary, --.

COLUMN 2:

Line 25, change "precludes." to -- precluded. --.

COLUMN 3:

Line 17, change "5dis" to -- 5d is --.

Line 56, change "come" to -- brought --.

UNITED STATES PATENT AND TRADEMARK OFFICE

CERTIFICATE OF CORRECTION

PATENT NO. : 5,029,839

DATED : July 9, 1991

INVENTOR(S) : Norio Kajiwara, et al.

It is certified that error appears in the above-identified patent and that said Letters Patent is hereby corrected as shown below:

COLUMN 4:

Line 18, change "frictions" to -- friction --.

COLUMN 6:

Line 67, change "abration" to -- abrasion --.

COLUMN 8:

Line 28, change "contract" to -- contact --.

Signed and Sealed this

Twenty-third Day of March, 1993

*Attest:*

STEPHEN G. KUNIN

*Attesting Officer*

*Acting Commissioner of Patents and Trademarks*